United States Patent [19]

Coxon et al.

[11] 4,109,108

[45] Aug. 22, 1978

[54] ATTENUATION OF SOUND WAVES IN DUCTS

[75] Inventors: Brian Coxon, Whitley Bay; Hubert Geoffrey Leventhall, London, both of England

[73] Assignee: National Research Development Corporation, London, England

[21] Appl. No.: 831,289

[22] Filed: Sep. 7, 1977

[30] Foreign Application Priority Data

Oct. 1, 1976 [GB] United Kingdom ..... 40832/76

[51] Int. Cl.[2] ..... E04B 1/99; G10K 11/04

[52] U.S. Cl. ..... 179/1 P; 181/206

[58] Field of Search ..... 179/1 P; 181/206

[56] References Cited

U.S. PATENT DOCUMENTS

| | | | |
|---|---|---|---|
| 2,043,416 | 6/1936 | Lueg | 179/1 |
| 4,044,203 | 8/1977 | Swinbanks | 179/1 P |

OTHER PUBLICATIONS

M. Swinbanks, "Active Control of Sound Propagation in Long Ducts", J. of Sound and Vib. (1973), 27(3), pp. 411–436.

M. Jessel and G. Mangiante, "Active Sound Absorbers in an Air Duct", J. of Sound and Vib. (1972), 23(3), 383–390.

*Primary Examiner*—Thomas W. Brown
*Assistant Examiner*—E. S. Kemeny
*Attorney, Agent, or Firm*—Cushman, Darby & Cushman

[57] ABSTRACT

Apparatus for attenuating a sound wave propagating in a given direction along a fluid-containing duct comprises two sound sources spaced along the duct in a given direction; a sound detector between the two sources at a null point at which sound emanating only from the two sources substantially cancels; and means for utilizing the output of the sound detector including a phase-shifter and a frequency-sensitive amplifier to control the operation of the sound sources so that they emit sound in relative antiphase and at equal amplitudes and at such phases relative to the phase of the detected sound that the resultant of the sound radiations emitted in the given direction substantially attenuates the sound wave propagating along the duct.

6 Claims, 8 Drawing Figures

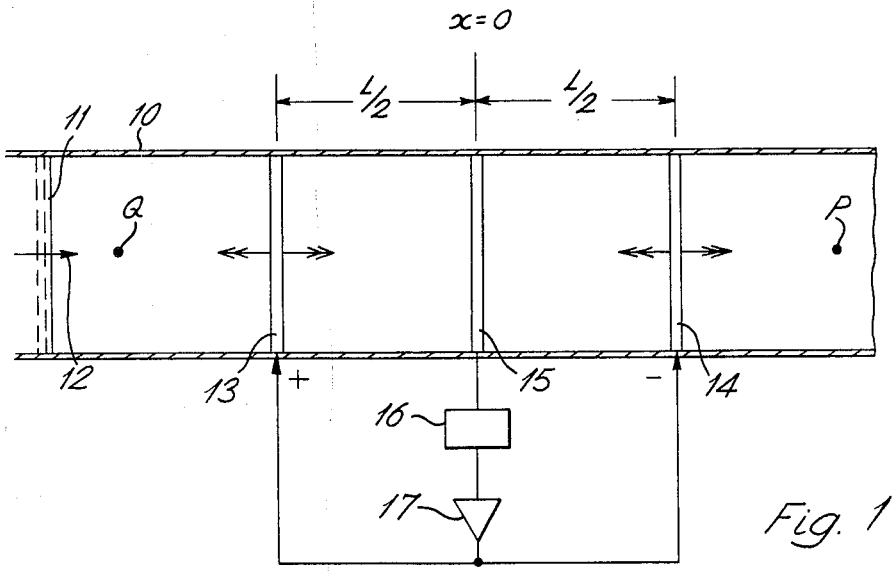
Fig. 1
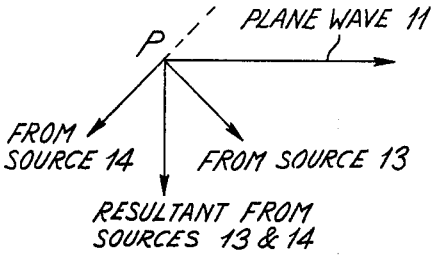
Fig. 2a
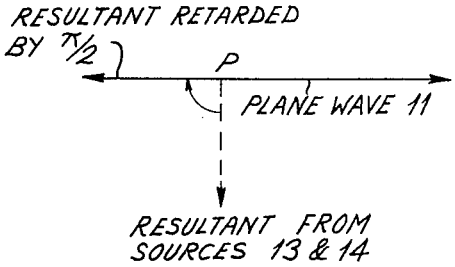
Fig. 2b
Fig. 2c
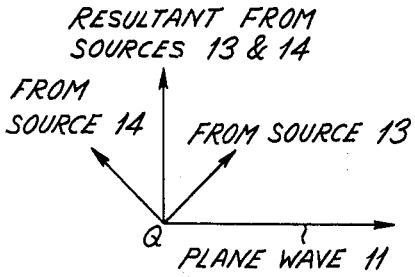
Fig. 2d
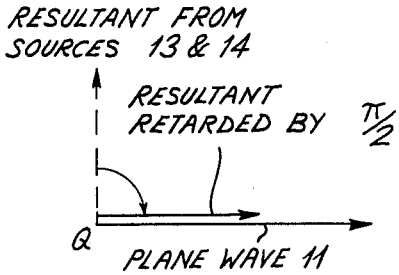

ATTENUATION OF SOUND WAVES IN DUCTS

This invention relates to the attenuation of sound waves in ducts. It is to be understood that the term "sound" used in this specification is to be construed in a broad sense because the invention is useful with non-audible frequencies.

Sound waves propagating in a given direction along a duct through a fluid (either a gas or a liquid) contained in the duct may be attenuated by various arrangements of a microphone and one or more loudspeakers, and such methods of attenuation are known as "active sound absorption". One arrangement is described by Jessel and Mangiante in the "Journal of Sound and Vibration" 1972 Volume 23 pages 383 - 90; the arrangement uses a monopole and dipole source in combination. In the same journal, 1973 Volume 27, pages 411 - 436, Swinbanks describes an arrangement using two spaced sources. However in such arrangements the efficiency of operation may vary considerably with the frequency of the sound.

According to the invention, a method of attenuating a sound wave propagating in a given direction along a duct through a fluid contained in the duct comprises detecting sound at a first position within the duct; and emitting sound into the duct at two positions spaced from the first position, one in the given direction and one in the opposite direction, so that the first position at which sound is detected is a null point at which sound radiations in the fluid emanating only from said two spaced positions substantially cancel; the sound emitted at the two positions being in relative antiphase and at equal amplitudes and at such phases relative to the phase of the detected sound that the resultant of the sound radiations emitted in the given direction substantially attenuates said sound wave propagating along the duct.

If the fluid in the duct is stationary, the null position will be midway between the two sound source means. If the fluid in the duct is flowing along the duct either in the given direction or in the opposite direction, the velocity of sound relative to the duct in the given direction will be respectively increased and decreased and the null position will be altered accordingly.

Also according to the invention apparatus for attenuating a wave propagating in a given direction along a duct through a fluid contained in the duct comprises two similar sound source means spaced along the duct in the given direction; sound detection means positioned in the duct between the two sound source means; and means for utilising the output of the sound detection means to control the operation of the sound source means in such a manner that they emit sound in relative antiphase and at equal amplitudes and at such phases relative to the phase of the detected sound that the resultant of the sound radiations emitted in the given direction substantially attenuates said sound wave propagating along the duct, the sound detection means being positioned at a null point at which sound radiations in the fluid emanating only from the sound source means substantially cancel.

In a method and apparatus according to the invention, the radiations from the sound sources cancel at the position of the sound detector, which can then detect any additional sound propagating along the duct.

The invention will now be described by way of example with reference to the accompanying drawings in which:

FIG. 1 illustrates diagrammatically an arrangement in accordance with the invention in which the fluid in the duct is stationary;

FIGS. 2(*a*), 2(*b*), 2(*c*) and 2(*d*) indicate the phase relationships at two points in the duct shown in FIG. 1:

Figure 3:
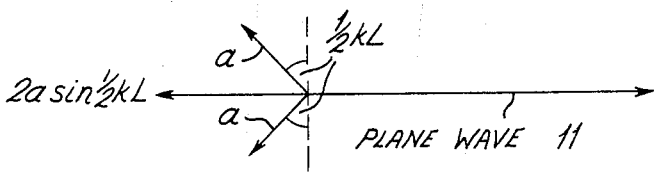
FIG. 3 is a vector diagram of the radiations at point P.

In FIG. 1, a duct 10 contains a stationary fluid, air, through which an unwanted plane sound wave 11 propagates in the given direction as indicated by the arrow 12. Two similar sound sources 13, 14 are spaced from a sound detector 15 at distances $\frac{1}{2}$L respectively opposite to and in the given direction. The detector 15 is connected to the sources through a variable phase shifter 16 and an amplifier 17. The sources are connected in relative antiphase by reversing the connections to the source 14 which is spaced in the given direction from the sound detector.

The sources 13, 14 radiate sound equally in both directions along the duct, as indicated by the double headed arrows. Considering only sound radiated by the sources and ignoring the plane wave for the moment, the sources are spaced at equal distances from the sound detector and the air in the duct is stationary, therefore the detector 15 is at the null position at which radiations from the sources will cancel.

Consider a point P spaced from the sound detector in the given direction at distance $x$ from the detector 15. FIG. 2*a* shows the relative phases at position P of the travelling plane wave 11 and of sound detected by the detector 15 and emitted by the two sources 13, 14. In the absence of a deliberately introduced phase shift the resultant of the radiations from sources 13 and 14 will always be retarded in phase by $\pi/2$ radians with respect to the travelling plane wave. If the resultant is deliberately retarded in phase by a further $\pi/2$ radians by appropriate alterations in phase of the radiations from the sources by use of phase shifter 16, the resultant will tend to cancel the plane wave 11, as shown in FIG. 2(*b*). As shown in the equivalent FIGS. 2(*c*) and 2(*d*), at point Q, spaced from both sources in the direction opposite to the given direction, the phase-retarded resultant will add to the plane wave 11.

At least a part of the theoretically required $\pi/2$ radians phase retardation may be provided inherently by the items of apparatus, and the variable phase shifter 16 may provide any additional required shift. However, the phase angles made by the plane wave 11 with the radiations from the sources 13 and 14 are frequency dependent, and are given by $\pm \frac{1}{2} kL$ where $$k = \frac{2\pi}{\lambda} = \frac{2\pi f}{c}.$$

Therefore when designing a practical system incorporating the inventive principle the amplitude of the sound radiation from the sources must be increased in an appropriate manner as the frequency decreases in order to maintain the cancellation condition in the given direction. Let the plane wave 11 have unit amplitude and let the radiations from sources 13 and 14 be of amplitude $a$. Then, as shown by the vector diagram, FIG.

Figure 4:
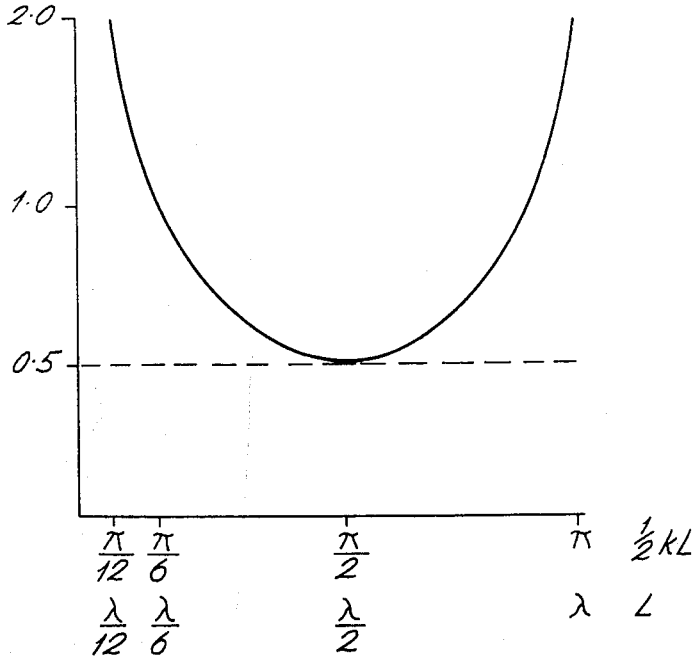
FIG. 4 is a plot of equation 1.

3, the resultant of the contributions from the sources is $2a \sin \frac{1}{2}kL$. For complete cancellation the required condition is $$2a \sin \tfrac{1}{2}kL = 1 \qquad (1)$$

at all frequencies. At low frequencies equation (1) tends to $a\alpha l/_{f}$; the relationship is illustrated in FIG. 4.

Mathematically, at point P the waves are:

$$e^{j(\omega t - kx)} - ae^{j\left(\omega t - kx + \frac{1}{2}kL - \frac{\pi}{2}\right)} + ae^{j\left(\omega t - kx - \frac{1}{2}kL - \frac{\pi}{2}\right)} =$$

$$\left[1 - ae^{-j\frac{\pi}{2}}\left(e^{-j\frac{kL}{2}} - e^{-j\frac{kL}{2}}\right)\right]e^{j(\omega t - kx)} =$$

$$\left[1 - 2a \sin \frac{kL}{2}\right]e^{j(\omega t - kx)} = 0$$

at all frequencies if the amplitude condition of Equation 1 is observed. Similarly it may be shown that at Q the resultant is $$\left[1 + 2a \sin \frac{kL}{2}\right]e^{j(\omega t - kx)}$$

$= 2e^{j(\omega t - kx)}$ if Equation 1 is satisfied.

The method is seen to have the potential for complete cancellation at all frequencies in the given direction, whilst the level in the opposite direction is doubled.

It has been assumed that the two sound sources radiate equally in all directions and that their output does not vary with frequency, that the sound detector is equally sensitive at all frequencies, and that the amplification factor of the amplifier is inherently constant at all frequencies.

Advantages of the invention are that the null position at which the sound detector 15 must be placed can be precisely determined; that the sound field at the detector is independent of the radiation from the sound sources, being due to the plane wave alone, and thus the stability is improved; and that only simple phase shifts, i.e. $\pi/2$ radians at all frequencies, are theoretically required.

One method of producing the required phase shift is by an integration technique which has the additional advantage that this would also approximate to the required amplitude characteristic when L is less than $\lambda/6$.

The invention has been described in theory using retardation in phase. It would also be possible to use phase advancements, but since a retardation is equivalent to a time delay, this time interval can conveniently be used to supply the sound to the sound sources after detection.

Figure 5:
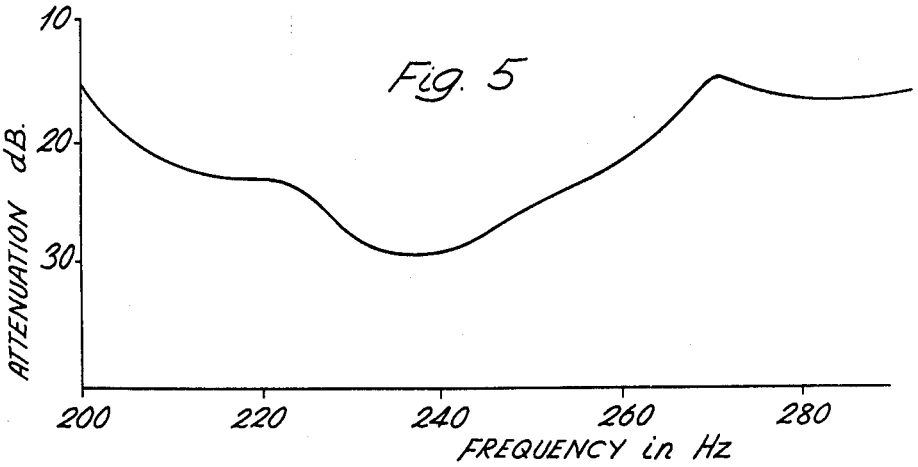
FIG. 5 illustrates the attenuation over a range of frequencies of an apparatus according to the invention.

In theory a $\pi/2$ radian phase retardation of the resultant of the sound from the two sound sources is required, and a phase shifter causing this retardation is provided. As explained above, in practice the items of apparatus themselves provide an inherent phase shift, and it may not be necessary to provide a phase shifter. FIG. 5 shows the attenuation achieved by an apparatus according to the invention over a frequency range in the region of 240Hz. The sound sources comprised two KEF Electronics Ltd. type B139 bass units arranged in still air in a duct at a separation of 0.2 meters and driven by 50 watt power amplifiers. A B and K (Bruel and Kjaer) ½ inch omnidirectional condenser microphone was arranged between the units and spaced equally from them. The microphone was connected to a B and K type 2603 microphone amplifier. There was no deliberately introduced phase retardation - the inherent retardation was sufficient to provide the substantial attenuation shown in the Figure. This mode of operation occurs up to the frequency at which the spacing of the sources $L = \lambda/2$.

The foregoing theoretical analysis and practical example was for a duct in which there was no air flow or for air flow at a velocity which is negligible with respect to the speed of sound, possibly up to 10% of that velocity.

Suppose now the velocity of sound is $C_o$ and the air in the duct flows in the given direction at velocity V. Let $M = V/_{Co}$. If the separation of the two sound sources remains as L, then the distance which the microphone must be moved in the given direction to bring it to the null point under the new conditions is ½ML. A theoretical retardation in phase of the resultant of the sounds from the two sources of ( $\pi/2$ - ½kML) radians is now required, assuming that the 180° phase retardation is applied to the sound source spaced from the sound detector in the given direction as in the case of the analysis in still air.

The invention has been described with reference to a plane wave for simplicity and clarity, but it is not limited to cancellation of such waves, and can also apply to acoustic radiation which propagates along the duct in a transverse mode although it is most useful at low frequencies which may be below the cut-off frequency of the duct.

The sound sources and sound detector may either each be a single device positioned centrally in the duct, or may each be an array of devices positioned around the walls of the duct, but the use of arrays requires careful matching of the devices within each array.

A method and apparatus according to the invention will usually be used to reduce low frequency noise, for which absorptive attenuators may be very bulky, expensive and inefficient. Usually absorptive attenuators are adequate at high frequencies. Examples of applications are in ventilation ducts and in jet engine outlets.

We claim:

1. A method of attenuating a sound wave propagating in a given direction along a duct through a fluid contained in the duct comprising detecting sound at a first position within the duct; and emitting sound into the duct at two positions spaced from the first position, one in the given direction and one in the opposite direction, so that the first position at which sound is detected is a null point at which sound radiations in the fluid emanating only from said two spaced positions substantially cancel; the sound emitted at the two positions being in relative antiphase and at equal amplitudes and at such phases relative to the phase of the detected sound that the resultant of the sound radiations emitted in the given direction substantially attenuates said sound wave propagating along the duct.

2. Apparatus for attenuating a sound wave propagating in a given direction along a duct through a fluid contained in the duct comprising two similar sound source means spaced along the duct in the given direction; sound detection means positioned in the duct between the two sound source means; and means for utilising the output of the sound detection means to control the operation of the sound source means in such a manner that they emit sound in relative antiphase and at equal amplitudes and at such phases relative to the phase of the detected sound that the resultant of the sound radiations emitted in the given direction substantially attenuates said sound wave propagating along the duct, the sound detection means being positioned at a null point at which sound radiations in the fluid emanating only from the sound source means substantially cancel.

3. Apparatus according to claim 2 in which the velocity of the fluid along the duct is negligible in comparison with the velocity of sound in the fluid and the sound detection means is midway between the two sound source means.

4. Apparatus according to claim 2 further comprising means to increase the amplitude of the output of the sound sources as the frequency of the emitted sound decreases, whereby the sound wave propagating along the duct is substantially attenuated over a range of sound frequencies by the resultant of the sound radiations emitted in the given direction.

5. Apparatus according to claim 2 further comprising phase shifting means arranged to alter the phase of the sound emitted by the sound source means.

6. Apparatus according to claim 5 comprising two sound sources spaced in the duct in the given direction; an omidirectional microphone between the sources; a variable phase shifter connected to the microphone; and an amplifier the input of which is connected to the phase shifter, and the output of which is connected to the sources so that the sources emit sound in antiphase.

* * * * *